US011570542B2

(12) United States Patent
Karp et al.

(10) Patent No.: US 11,570,542 B2
(45) Date of Patent: Jan. 31, 2023

(54) MODULAR LISTENING AND COMMUNICATION DEVICES TO BE USED AS AN OVER-THE-EAR HEADSET, NECK SPEAKER WITH MICROPHONE, OR STANDALONE SPEAKER AND MICROPHONE

(71) Applicant: Sony Interactive Entertainment LLC, San Mateo, CA (US)

(72) Inventors: Sarah Karp, Foster City, CA (US); John Charles Zarganis, San Mateo, CA (US)

(73) Assignee: Sony Interactive Entertainment LLC, San Mateo, CA (US)

( * ) Notice: Subject to any disclaimer, the term of this patent is extended or adjusted under 35 U.S.C. 154(b) by 0 days.

(21) Appl. No.: 17/161,024

(22) Filed: Jan. 28, 2021

(65) Prior Publication Data

US 2022/0239997 A1 Jul. 28, 2022

(51) Int. Cl.
*H04R 1/00* (2006.01)
*H04R 1/10* (2006.01)

(52) U.S. Cl.
CPC ..... *H04R 1/105* (2013.01); *H04R 1/1008* (2013.01); *H04R 1/1041* (2013.01)

(58) Field of Classification Search
CPC .. H04R 1/1041; H04R 1/1025; H04R 1/1008; H04R 1/1066; H04R 2420/07; H04R 2420/09
See application file for complete search history.

(56) References Cited

U.S. PATENT DOCUMENTS 9,832,560 B1 * 11/2017 Bagga ..... H04R 1/1041

* cited by examiner

*Primary Examiner* — Amir H Etesam
(74) *Attorney, Agent, or Firm* — John L. Rogitz

(57) ABSTRACT

An audio device can be reconfigured to serve a multi-purpose communication experience as a neck speaker, a headset, a speaker, or standalone microphone, depending on the user's preference. For wearable audio products, comfort is a key aspect of the listening experience. By allowing the user to adjust the wearable position of the components, the user can choose the comfort configuration that is best for him and his daily usage or switch back and forth from the configurations to match their environment. To enable others to hear what the user is listening to, the user can wear it on her neck or place it on a table, but if the user wants privacy, she can wear it around her head.

20 Claims, 9 Drawing Sheets

MODULAR LISTENING AND COMMUNICATION DEVICES TO BE USED AS AN OVER-THE-EAR HEADSET, NECK SPEAKER WITH MICROPHONE, OR STANDALONE SPEAKER AND MICROPHONE

FIELD

The application relates generally to modular listening and communication devices that are configurable device to be used as an over-the-ear headset, neck speaker with microphone, or standalone speaker and microphone.

BACKGROUND

The headphone listening experience can involve incoming audio (music, friend's voices, movies, etc. . . . ) a person is listening to and outgoing audio (the person's voice) that the person want to transmit to others. As understood herein, a difficulty arises when the person wishes to bridge the gap and communicate with someone digitally and in person. Existing audio equipment makes the person select only one mode, wither to be immersed in the digital world through headphones that nobody else in the room can interact with, or to output the audio through speakers, disconnecting the person from digital friends.

In particular, conventional headphones are locked in a singular position and offer the user little to no flexibility in how a user can experience and share the audio. Many users must switch between two devices—a speaker/soundbar or headphones—to get the experiences they desire.

SUMMARY

Present principles provide a convertible audio device so that users can achieve two very different experiences with one device.

An audio device can be reconfigured to serve a multipurpose communication experience as a neck speaker, a headset, a speaker, or standalone microphone, depending on the user's preference. For wearable audio products, comfort is a key aspect of the listening experience. By allowing the user to adjust the wearable position of the components, the user can choose the comfort configuration that is best for her and her daily usage or switch back and forth from the configurations to match their environment. To enable others to hear what the user is listening to, the user can wear it on her neck or place it on a table, but if the user wants privacy, she can wear it around her head.

Accordingly, a device includes at least one headband with an inner surface and a surface other than the inner surface, such as the opposite surface of the inner surface or an edge bordering the inner surface. At least left and right inner couplings are on the inner surface and at least left and right outer couplings are on the surface other than the inner surface. The device also includes at least left and right ear cups each including at least one speaker, at least one microphone, at least one wireless transceiver, and at least one ear cup coupling configured to detachably engage respective inner and outer couplings of the headband.

In example embodiments the left and right ear cups are detachably engageable with the respective left and right inner couplings to establish a headphone configuration of the device. The left and right ear cups may be detachably engageable with the respective left and right outer couplings to establish a neck ring configuration of the device. Further, the left and right ear cups can be disengageable from the couplings of the headband to establish a free-standing configuration of the device in which the respective speakers are operable to play audio.

In some implementations the ear cup couplings can be threadably engageable with the couplings of the headband. In other implementations the ear cup couplings can be snappingly engageable with the couplings of the headband. In yet other implementations the ear cup couplings can be magnetically engageable with the couplings of the headband.

The surface other than the inner surface may be an outer surface of the headband opposite the inner surface. The surface other than the inner surface may be an edge surface of the headband bounding the inner surface.

In another aspect, an audio device includes at least two speaker assemblies and at least one band configured to be worn by a person. The speaker assemblies are movable relative to the band to a standalone configuration, in which the speaker assemblies are distanced from the band and are operable to play audio, a headphone configuration, in which the speaker assemblies are engaged with a first surface of the band, and a neck ring configuration, in which the speaker assemblies are engaged with a second surface of the band.

In another aspect, a method includes playing audio on left and right ear cups engaged with an inner part of a headband such that a person wearing the headband can listen to the audio with the ear cups closely juxtaposed with the ears of the person. The method also includes playing audio on the left and right ear cups engaged with an outer part of the headband such that a person wearing the headband can listen to the audio with the ear cups oriented away from the ears of the person.

The details of the present application, both as to its structure and operation, can best be understood in reference to the accompanying drawings, in which like reference numerals refer to like parts, and in which:

DETAILED DESCRIPTION

Figure 1:
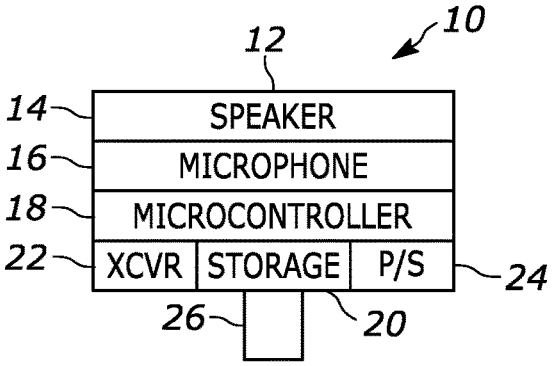
FIG. 1 illustrates internal components of an ear cup consistent with present principles.

Now referring to FIG. 1, a speaker assembly 10 of an audio device is shown configured in the example shown as an ear cup 12, also illustrated further in subsequent figures described below. The speaker assembly 10 includes one or more audio speakers 14, may include one or more microphones 16, and may send signals from the microphone and provide signals to the speaker 14 for play thereof using one or more microcontrollers 18 such as a microprocessor or digital signal processor (DSP) and/or other processing circuit. The microcontroller 18 may access data and instructions on one or more data storages 20 such as disk-based or solid-state storage, and may communicate with a source of audio wirelessly using one or more wireless transceivers 22 such as but not limited to Wi-Fi transceivers, Bluetooth transceivers, wireless telephony transceivers, etc. The electrical components shown in FIG. 1 may be energized by one or more power supplies 24 such as a primary cell battery, a rechargeable battery, a capacitive power supply, etc.

As also shown in FIG. 1, on its housing the speaker assembly 10 may include a coupling 26.

Figure 2:
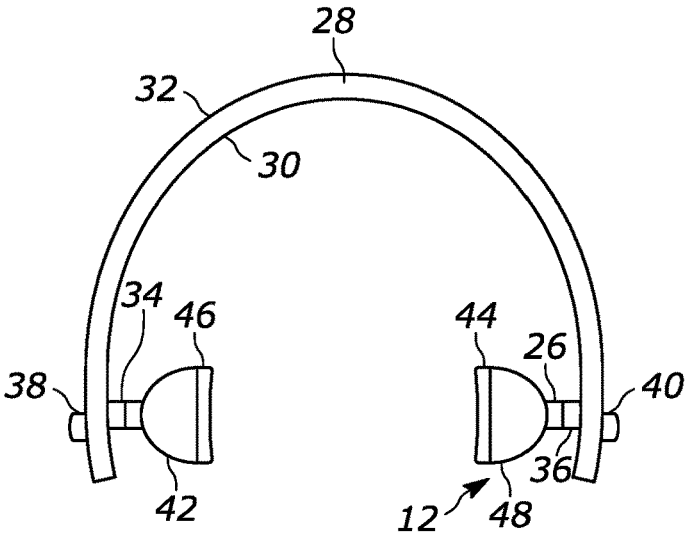
FIG. 2 illustrates a device in the headphone configuration.

FIG. 2 illustrates function of the coupling 26, referred to for ease of description below as an ear cup coupling. At least one headband 28 that may be arcuate as shown to conform to the shape of a human head includes an inner surface 30 and an outer surface 32. The outer surface 32 is opposite the inner surface 30 and thus is parallel to the inner surface 30. At least left and right inner couplings 34, 36 are arranged on the inner surface 30 of the headband 28, i.e., facing toward a person who is wearing the headband on her head, while at least left and right outer couplings 38, 40 on the outer surface 32 of the headband, i.e., facing away from a person who is wearing the headband on her head. It will be appreciated that the headband couplings 34-40 are located generally at the level of the ear of a wearer of the headband in the example shown. In other examples, at least the outer couplings 38, 40 may be spaced from the level of the ear, e.g., they may be arranged near the top of the headband 28, the free ends of the headband 28, or any location therebetween.

At least left and right speaker assemblies 42, 44, each of which may contain some or all of the components shown in FIG. 1, and each of which is configured as an ear cup in the example shown, can be engaged with the headband 28 by means of the respective ear cup coupling 26. Each example ear cup may include an inner generally circular or ovular cushion 46 that is attached to a cup-shaped plastic shell 48. The ear cup coupling 26 of each ear cup is attached to the cup-shaped shell 48 generally near or at the apex of the cup, essentially opposite the cushion 46. The attachment may be a stationary attachment as by gluing or rf sealing or it may be a pivot attachment to allow for movement between the shell 48 and ear cup coupling 26.

In any case, each ear cup coupling 26 can be detachably engaged with either the respective inner or outer headband coupling.

In FIG. 2, the left and right ear cups 42, 44 are detachably engaged with the respective left and right inner couplings 34, 36 of the headband 28 to establish a headphone configuration of the device. The attachment is by means of engaging the respective ear cup couplings 26 with the respective inner couplings.

Figure 3:
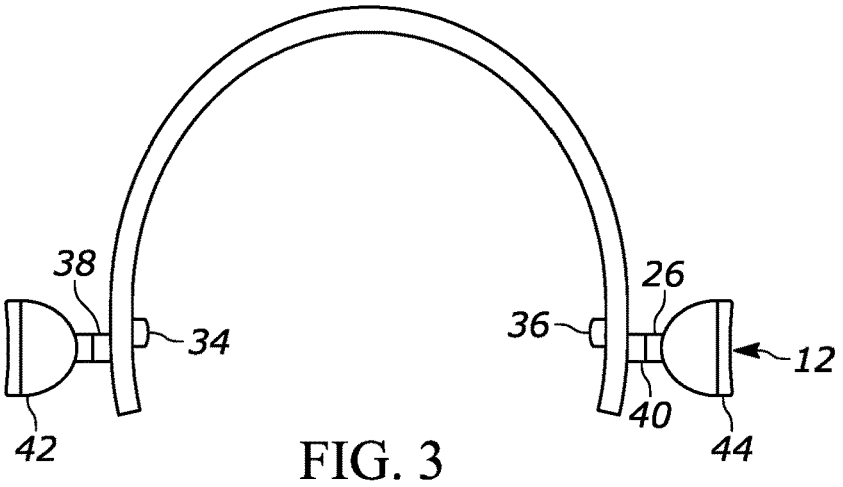
FIG. 3 illustrates the device in the neck ring configuration.

In FIG. 3, the left and right ear cups are detachably engaged with the respective left and right outer couplings 38, 40 to establish a neck ring configuration of the device.

Figure 3A:
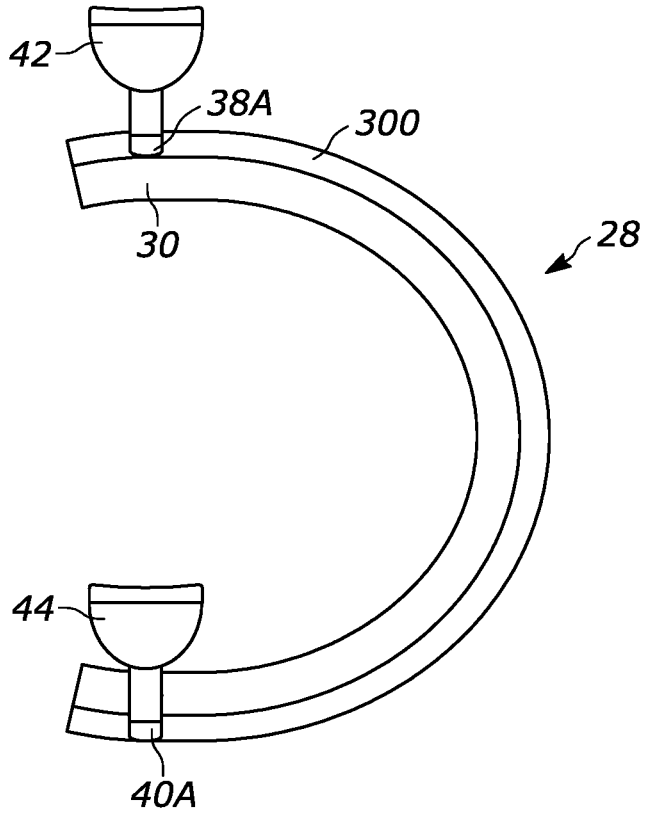
FIG. 3A illustrates the device in an alternate neck ring configuration.

In FIG. 3A, outer couplings 38A, 40A are on an edge surface 300 of the headband 28, and the left and right ear cups 42, 44 are detachably engaged with the respective left and right outer couplings 38A, 40A. The edge surface 300 bounds the inner surface 30 and is between the inner and outer surfaces of the headband.

Figure 4:
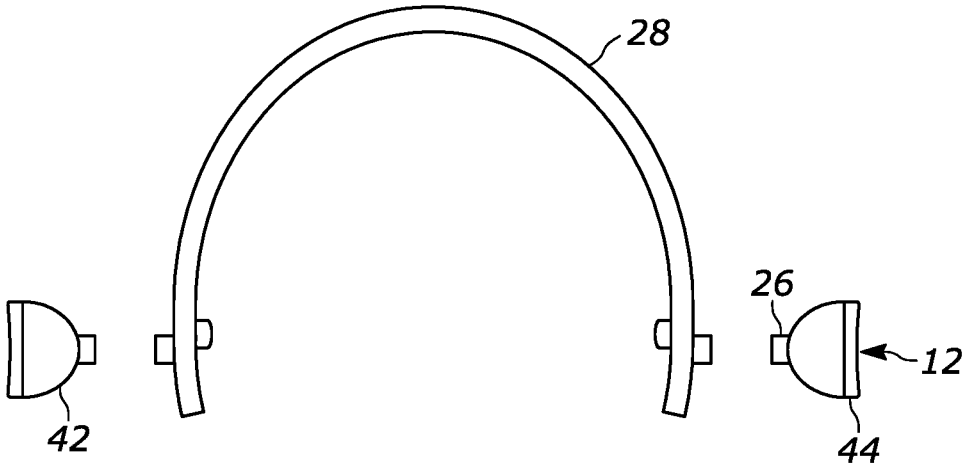
FIG. 4 illustrates the device in the free-standing configuration.

In FIG. 4, the left and right ear cups are disengaged from all couplings of the headband to establish a free-standing configuration of the device in which the respective speakers of the ear cups are operable to play audio.

Figure 5:
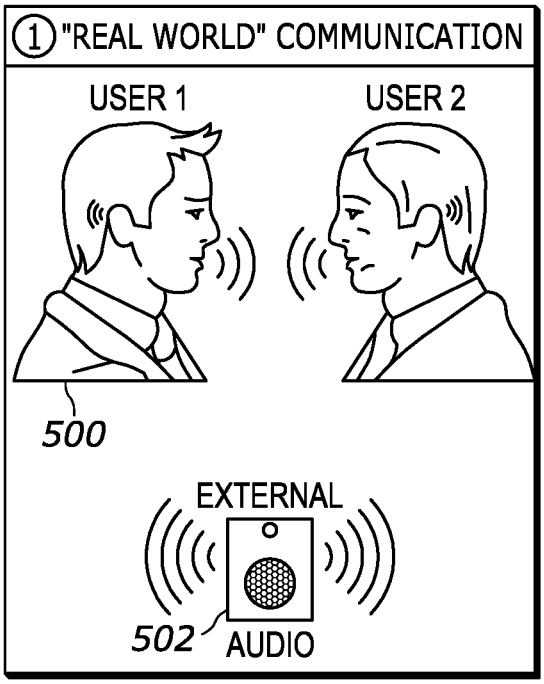
FIG. 5 schematically illustrates two people communicating using real world techniques.

In this way, a single audio device established by the headband 28 and ear cups 42, 44 can be flexibly applied to the following situations. In FIG. 5, two users 500 are conversing in person while listening to media (for example, music) played by a media player 502. All parties can hear each other and their music, sharing the experience.

Figure 6:
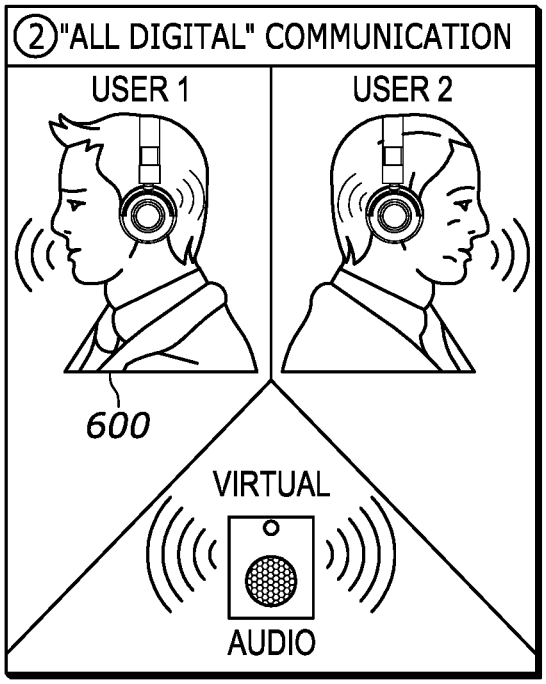
FIG. 6 schematically illustrates two people communicating using digital techniques.

In FIG. 6, all communication is taking place digitally between two users 600 who may be remote from each other. Each user's voice is picked up by the present audio device being worn in the headphone configuration as shown and transmitted to the other audio device, while sharing digital audio together, or playing a game together using a virtual audio source 602.

Figure 7:
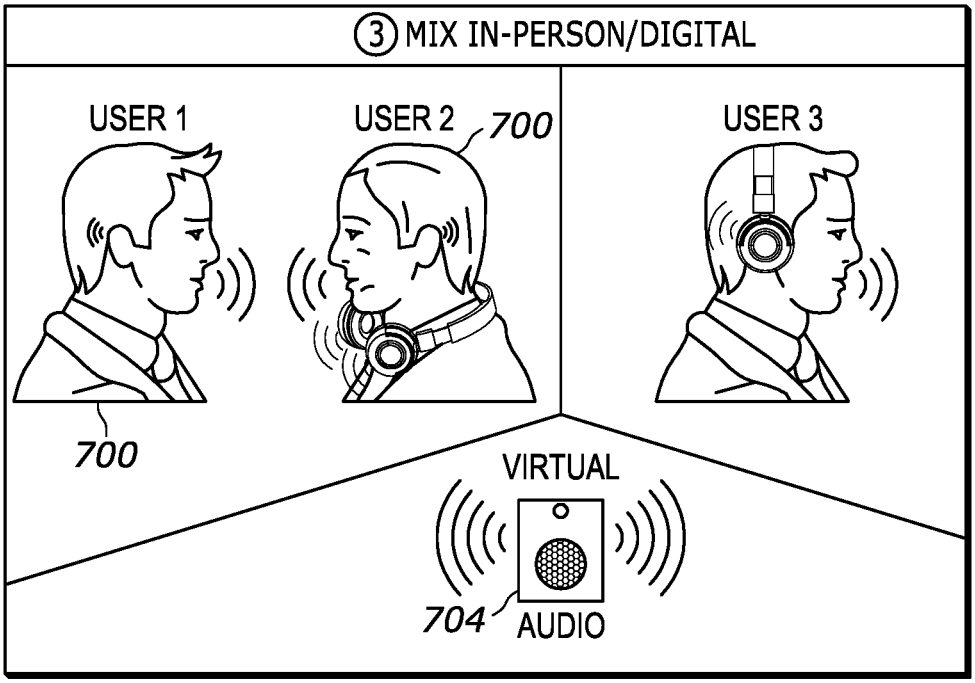
FIG. 7 schematically illustrates multiple people communicating using hybrid techniques consistent with present principles with one person operating a device in the neck ring configuration and another person operating a device in the headphone configuration.

In contrast, consider the hybrid situation in FIG. 7, in which two users 700 who are within earshot of each other in the same physical location may speak to each other naturally while also speaking with a third user 702 who may be remote from the local users 700. The third user 702 may wear his audio device in the headphone configuration while one (or both) of the local users 700 may wear their audio devices in the neck ring configuration. This allows the local users 700 to converse naturally with each other and, via the speaker (to hear the third user 702) and microphone (to pick up their speech and send it to the third user) of their neck ring-configured audio device with the remote user 702 as well. In other words, in FIG. 7 all the parties both digital and in person can converse with each other and enjoy the digital media from a source 704 using one type of device in two configurations.

Figure 8:
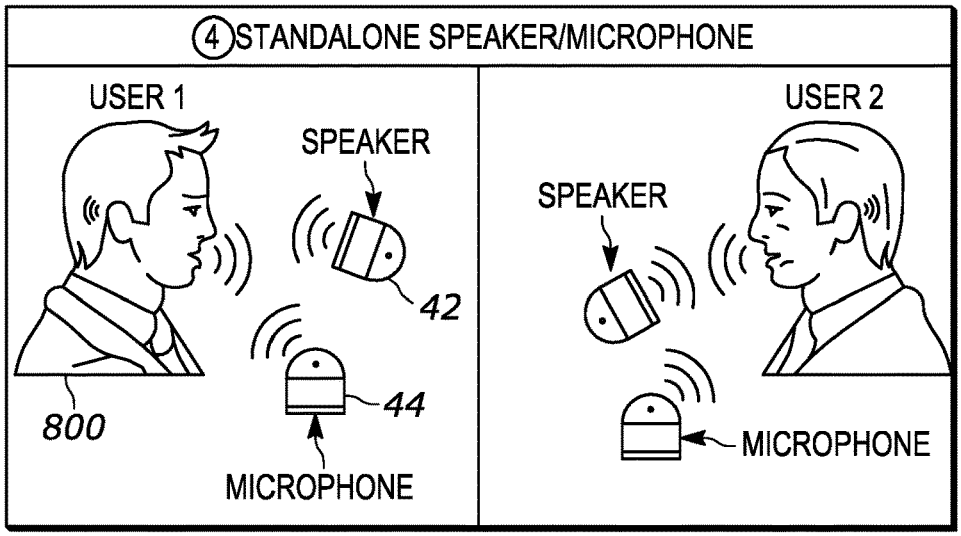
FIG. 8 schematically illustrates two people communicating with their respective devices in the free-standing configuration.
Figure 9:
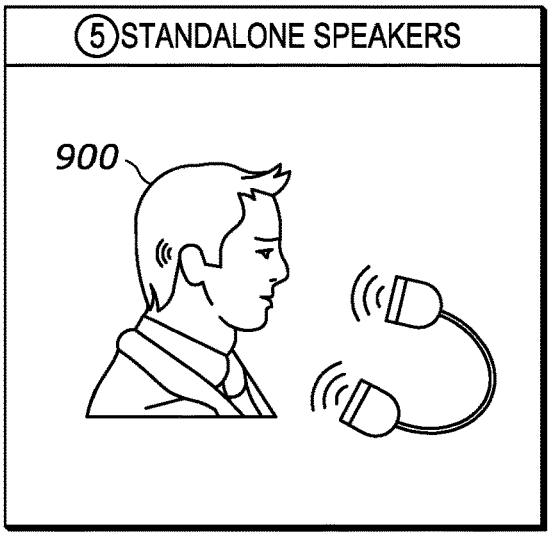
FIG. 9 illustrates a person with a device for communication.

FIGS. 8 and 9 show the potential for the instant audio device to be used as standalone speakers/microphones when the ear cups 42, 44 are detached from respective headbands of the audio devices. In FIG. 8 two potentially remote users 800 can essentially engage in a conference call with each other using their detached ear cups, e.g., by using the speaker of one ear cup and the microphone of the other ear cup, programmatically controlled by the respective microcontroller of the audio device. In FIG. 9, a single user 900 uses his ear cups as a standalone speaker system.

The dual ability of the audio device to switch between the desire to share the experience or preserve privacy is an advantageous feature of the audio device in addition to the comfort benefits. This is owing to the modular wearing nature of the audio device availability. The user can configure this device to be worn as a traditional headset, as a neck speaker, or as two individual speakers and microphones. This allows multiple configurations of listening experiences in one device that otherwise requires three separate devices.

The above features are facilitated by enabling the ear cups to detachably engage to different points along the headband allowing the user to convert the headband to a neck support. The attachment points can be optimized to deliver audio towards the ear. These ear cups can also be completely detached and used as standalone microphone/speaker pairs.

Figure 10:
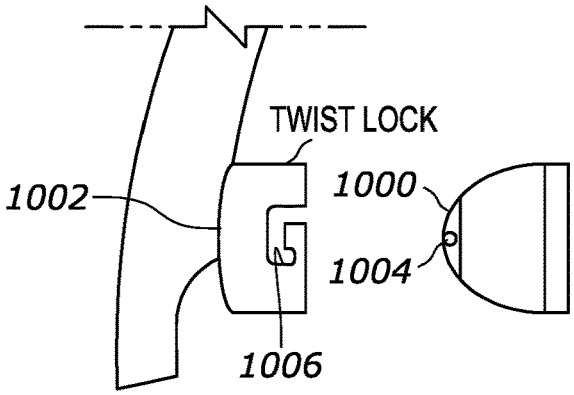
FIGS. 10 and 10A illustrate a first type of coupling for permitting movable engagement of an ear cup with a headband.
Figure 10A:
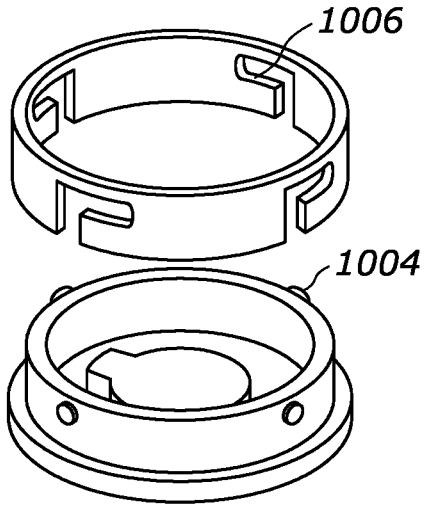

Potential attachment mechanisms are illustrated in FIG. 10 et seq. In FIGS. 10 and 10A, an ear cup coupling 1000 of an ear cup consistent with disclosure herein is threadably engageable with a coupling 1002 of the headband. To this end, a land 1004 of the ear cup coupling 1000 can slidably engage an L-shaped groove 1006 in the headband coupling 1002 to allow the ear cup to be rotated on and off the headband. The land may be formed on the headband coupling and the groove on the ear cup if desired.

Figure 11:
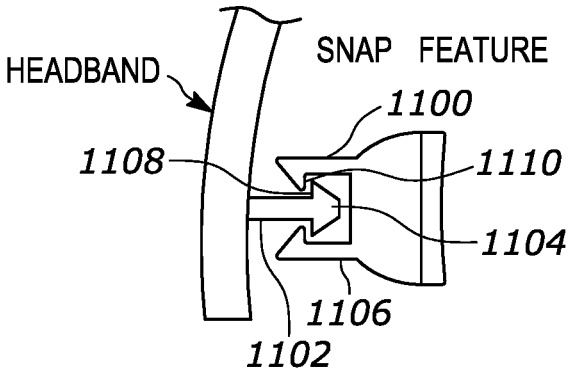
FIG. 11 illustrates a second type of coupling for permitting movable engagement of an ear cup with a headband.
Figure 12:
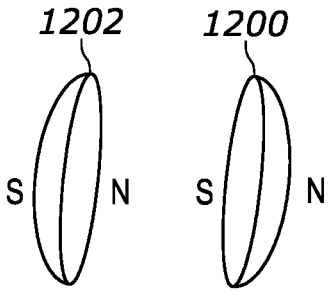
FIG. 12 illustrates a third type of coupling for permitting movable engagement of an ear cup with a headband.

In FIG. 11, an ear cup coupling 1100 of an ear cup consistent with disclosure herein is snappingly engageable with a coupling 1102 of the headband, e.g., in an interference fit. If desired to promote the secureness of the interference fit, the headband coupling 1102 may be formed with an enlarged frusto-conical head 1104 that can be pushed between arms 1106 in the ear cup coupling 1100 to ride against the arms 1106 to slightly deform the arms outwardly. When the transverse flange 1108 of the head 1104 clears transverse flanges 1110 of the arms 1106, material bias causes the arms 1106 to pivot inwardly, trapping the head 1104 between the arms 1106. Pulling the head 1104 out of the arms 1106 can be done with mild hand pressure. It is to be understood that the head may be formed on the ear cup coupling and the arms on the headband coupling Yet again, FIG. 12 illustrates an ear cup coupling 1200 that may include or be established by a magnet for magnetically engaging a headband coupling 1202 that also may include or be established by a magnet, with example poles indicated. In this way the ear cup coupling 1200 is magnetically engageable with the coupling 1202 of the headband.

It is preferred that the magnets 1200, 1202 in FIG. 12 be positioned by a distance sufficient from the speaker drivers to prevent magnetic interference. Magnetic shields may be interposed between the coupling magnets and the speaker drivers.

Figure 13:
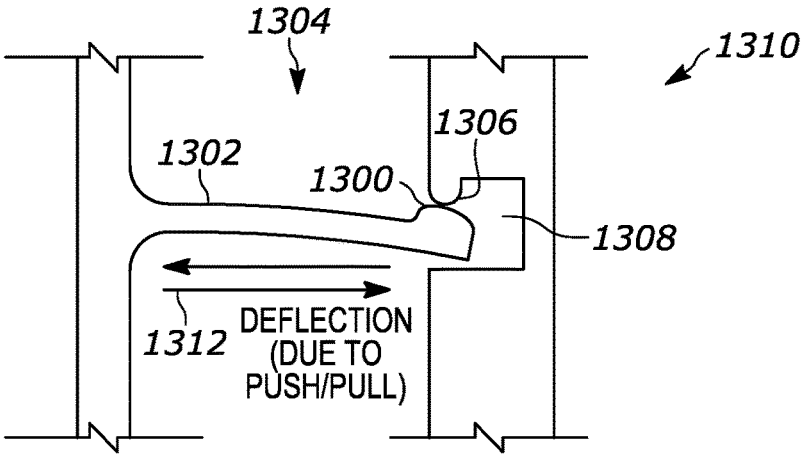
FIGS. 13 and 14 illustrate another mechanism for movably attaching ear cups to a headband.
Figure 14:
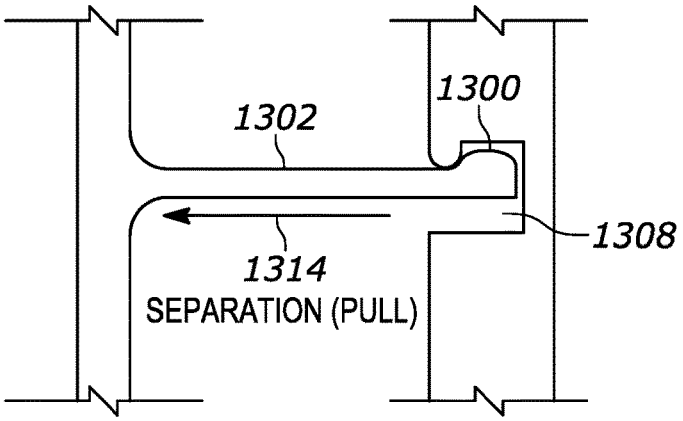

FIGS. 13 and 14 illustrate that a bump 1300 on an arm 1302 of a headband coupling 1304 can be pushed against an edge 1306 of a cavity 1308 of an ear cup coupling 1310 to deflect the arms 1302 until the bump 1300 clears the edge 1306 to nest in the cavity 1308. This is indicated by the right arrow 1312. As indicated by the left arrow 1314 in FIG. 14, the headband coupling 1304 can be pulled away from the ear cup to deflect the arm 1302 down until the head 1300 clears the edge 1306 to disengage the couplings. As is the case with the disclosed couplings, the couplings may be reversed, i.e., the coupling disclosed to be on the headband can be on the ear cup and vice-versa.

Figure 15:
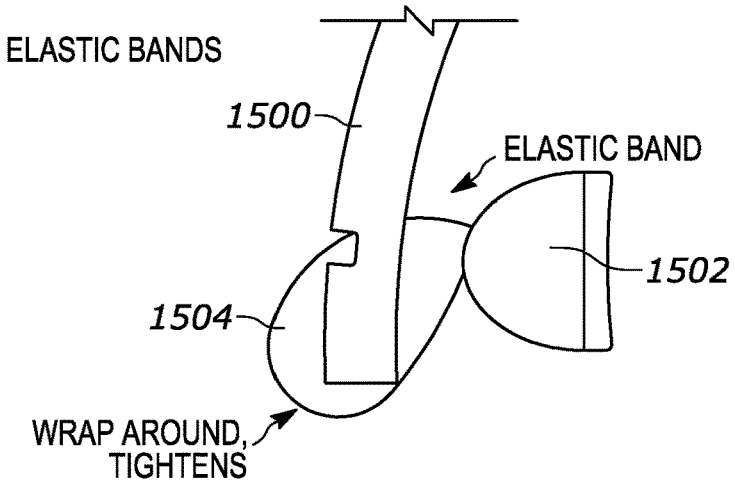
FIG. 15 illustrates another mechanism for movably attaching ear cups to a headband.

FIG. 15 illustrates that an endless elastic band 1500 can be placed around an ear cup 1502 and headband 1504 to hold the components together. The band 1500 may have opposed ends that can snap together to create an endless band.

Figure 16:
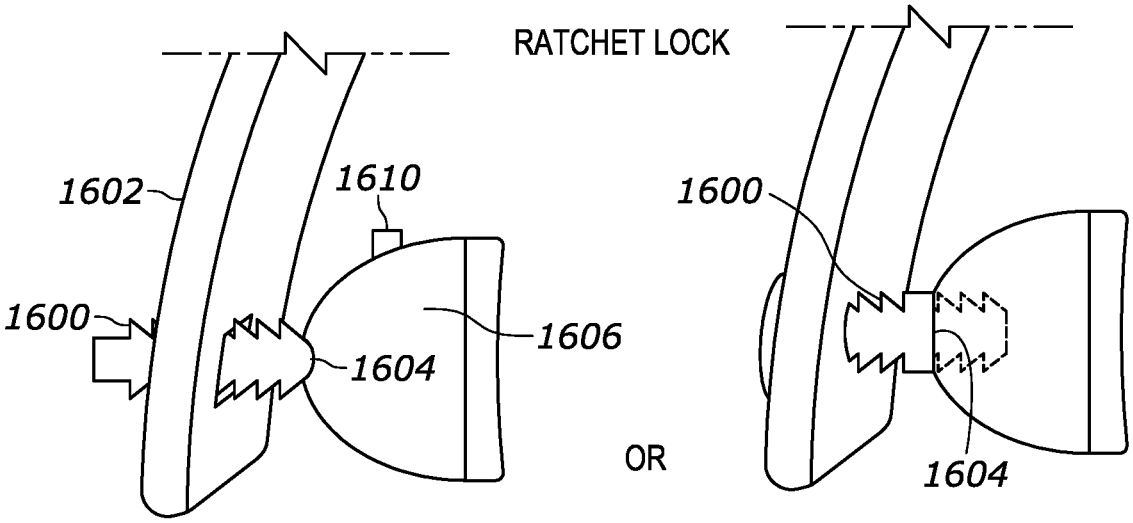
FIG. 16 illustrates another mechanism for movably attaching ear cups to a headband.

FIG. 16 illustrates a ratchet style mechanism in which a notched strap 1600 similar to a tie wrap may extend from a headband 1602 to engage an opening 1604 in an ear cup 1606. A key or button 1610 may be pressed to release the strap from the opening by, e.g., enlarging the opening through temporary material deformation or other mechanism.

Figure 17:
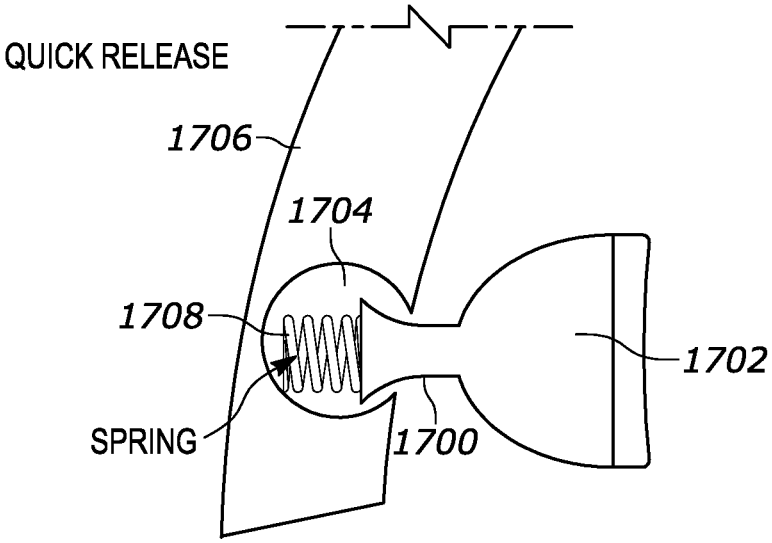
FIG. 17 illustrates another mechanism for movably attaching ear cups to a headband.

FIG. 17 illustrates a quick release mechanism in which a mushroom-shaped post 1700 on an ear cup 1702 can be pushed into an opening 1704 of a headband coupling 1706 to lock the parts together. A second push inward against a spring 1708 in the opening 1704 causes disengagement of the post 1700 from the opening 1704.

Figure 18:
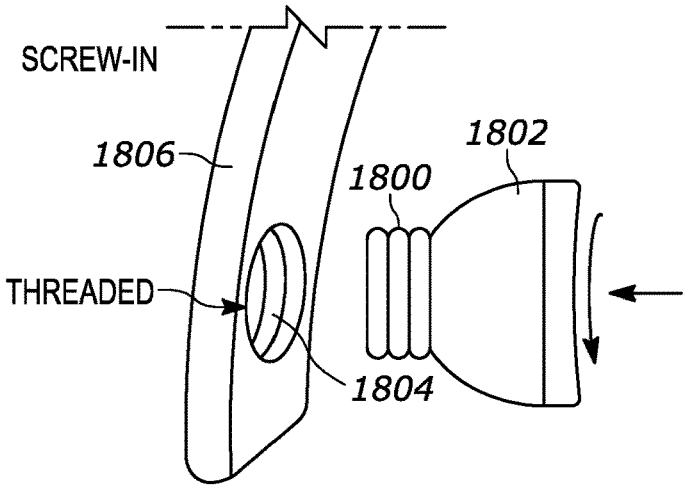
FIG. 18 illustrates another mechanism for movably attaching ear cups to a headband.

FIG. 18 illustrates another threadable attachment mechanism in which a threaded post 1800 on an ear cup 1802 threadably engages a socket 1804 of a headband 1806 such that the ear cup 1802 can be engaged and disengaged from the headband by rotation.

Figure 19:
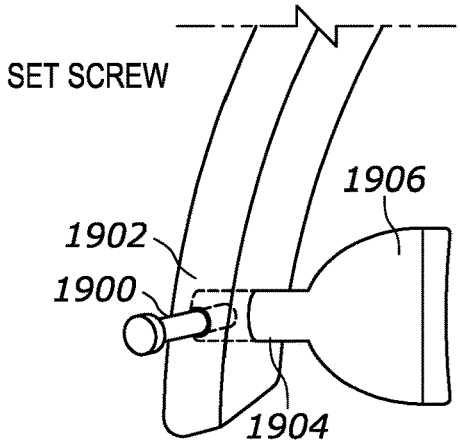
FIG. 19 illustrates another mechanism for movably attaching ear cups to a headband.

FIG. 19 illustrates that a set screw 1900 can be rotated through a hole in a headband flange 1902 to urge against a post 1904 of an ear cup 1906 to hold the ear cup in the headband flange. Multiple holes and headband flanges may be provided at various desired locations.

Figure 20:
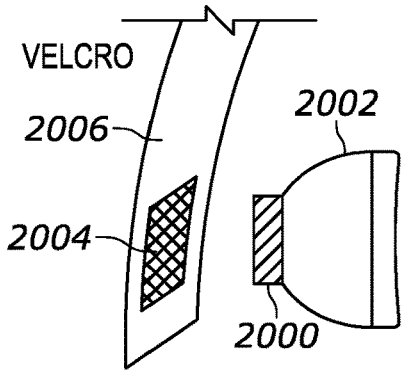
FIG. 20 illustrates another mechanism for movably attaching ear cups to a headband.

FIG. 20 illustrates that a hook-and-loop fastener 2000 such as Velcro can be provided on an ear cup 2002 to engage and disengage a complementary fastener 2004 on a headband 2006, which may have multiple such fasteners at various desired locations on the headband.

Figure 21:
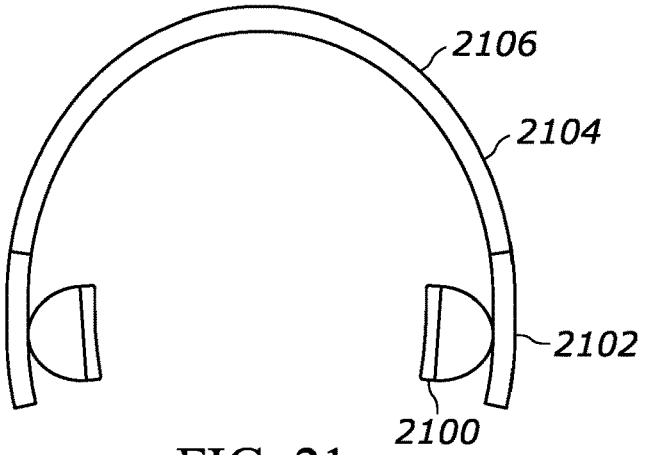
FIGS. 21-23 illustrate another mechanism for movably attaching ear cups to a headband.
Figure 22:
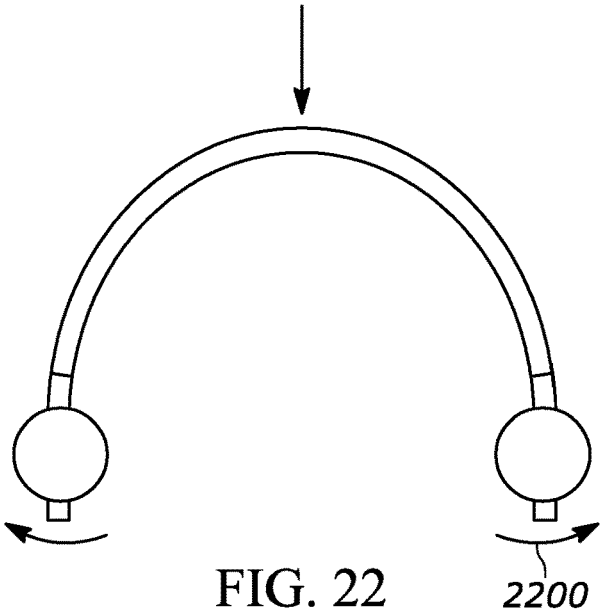
Figure 23:
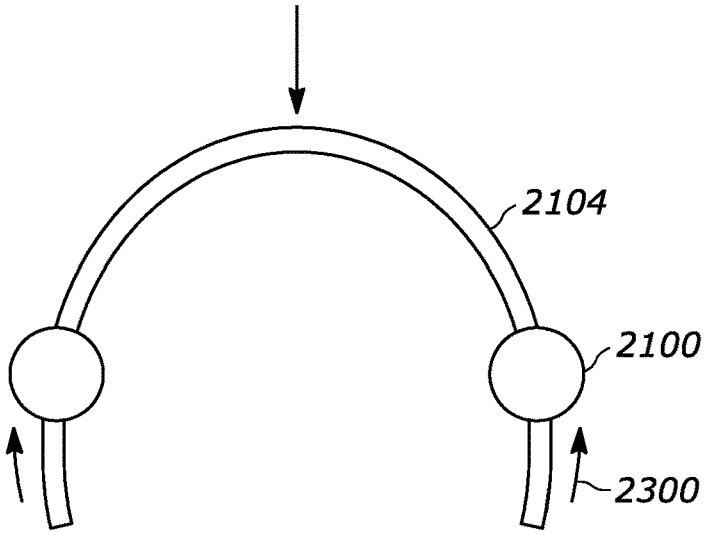

FIGS. 21-23 illustrate that ear cups 2100 may be provided on respective segments 2102 that are rotatably and/or translationally engaged with complementary (e.g., hollow) segments 2104 of a headband 2106. In this way, the ear cups may be positioned in the headphone configuration (FIG. 21) and moved to the neck ring configuration (FIG. 22) by rotating the ear cups relative to the headband as indicated by the arrows 2200 in FIG. 22. The ear cups 2100 also may be translationally moved up and down the headband segments 2104 for fit as indicated by the arrows 2300 in FIG. 23.

Components included in one embodiment can be used in other embodiments in any appropriate combination. For example, any of the various components described herein and/or depicted in the Figures may be combined, interchanged, or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

It will be appreciated that whilst present principals have been described with reference to some example embodiments, these are not intended to be limiting, and that various alternative arrangements may be used to implement the subject matter claimed herein.

What is claimed is:

1. A device comprising:

at least one headband comprising an inner surface and a surface other than the inner surface, at least left and right inner couplings being on the inner surface and at least left and right outer couplings being on the surface other than the inner surface;

left and right ear cups each comprising at least one speaker, at least one microphone, at least one wireless transceiver, and at least one ear cup coupling configured to movably engage respective inner and outer couplings of the headband, wherein the device comprises one and only one left ear cup and one and only one right ear cup.

2. The device of claim 1, wherein the left and right ear cups are detachably engageable with the respective left and right inner couplings to establish a headphone configuration of the device.

3. The device of claim 1, wherein the left and right ear cups are detachably engageable with the respective left and right outer couplings to establish a neck ring configuration of the device.

4. The device of claim 1, wherein the left and right ear cups are disengageable from the couplings of the headband to establish a free-standing configuration of the device in which the respective speakers are operable to play audio.

5. The device of claim 1, wherein the surface other than the inner surface is an outer surface of the headband opposite the inner surface.

6. The device of claim 1, wherein the ear cup coupling of the left ear cup is snappingly engageable with the left inner coupling of the headband.

7. The device of claim 1, wherein the surface other than the inner surface is an edge surface of the headband bounding the inner surface.

8. An audio device comprising:

two and only two speaker assemblies;

at least one band configured to be worn by a person, wherein the speaker assemblies are movable relative to the band to a standalone configuration, in which the speaker assemblies are distanced from the band and are operable to play audio, a headphone configuration, in which the speaker assemblies are engaged with a first surface of the band, and a neck ring configuration, in which the speaker assemblies are engaged with a second surface of the band.

9. The audio device of claim 8, wherein at least one speaker assembly comprises at least one microphone.

10. The audio device of claim 8, wherein the speaker assemblies are configured as left and right ear cups.

11. The audio device of claim 10, wherein the headband comprises at least left and right inner couplings being on the first surface and at least left and right outer couplings being on the second surface and the left and right ear cups each comprise at least one speaker, at least one microphone, at least one wireless transceiver, and at least one ear cup coupling configured to detachably engage respective inner and outer couplings of the headband.

12. The audio device of claim 11, wherein the left and right ear cups are detachably engageable with the respective left and right inner couplings to establish the headphone configuration.

13. The audio device of claim 11, wherein the left and right ear cups are detachably engageable with the respective left and right outer couplings to establish the neck ring configuration.

14. The audio device of claim 11, wherein the left and right ear cups are disengageable from the couplings of the headband to establish the free-standing configuration.

15. The audio device of claim 11, wherein the ear cup coupling of the left ear cup is threadably engageable with the left inner coupling of the headband.

16. The audio device of claim 11, wherein the ear cup coupling of the left ear cup is snappingly engageable with the left inner coupling of the headband.

17. The audio device of claim 11, wherein the ear cup coupling of the left ear cup is magnetically engageable with the left inner coupling of the headband.

18. A method, comprising:

playing audio on one and only one left ear cup and one and only one right ear cup engaged with an inner part of a headband such that a person wearing the headband can listen to the audio with the ear cups closely juxtaposed with the ears of the person; and playing audio on the left and right ear cups engaged with an outer part of the headband such that a person wearing the headband can listen to the audio with the ear cups oriented away from the ears of the person.

19. The method of claim 18, comprising playing audio on the left and right ear cups with the ear cups disengaged with the headband and wirelessly receiving signals to play audio.

20. The method of claim 18, comprising moving the ear cups relative to the headband.

* * * * *